US007068569B2

(12) United States Patent
Dutkiewicz

(10) Patent No.: US 7,068,569 B2
(45) Date of Patent: Jun. 27, 2006

(54) APPARATUS AND METHOD FOR DISPLAYING TIME AND RANDOMLY-SELECTED TEXT INFORMATION

(76) Inventor: John Dutkiewicz, 3468 Essex Ave., Atlanta, GA (US) 30339

( * ) Notice: Subject to any disclaimer, the term of this patent is extended or adjusted under 35 U.S.C. 154(b) by 305 days.

(21) Appl. No.: 10/637,265

(22) Filed: Aug. 8, 2003

(65) Prior Publication Data

US 2005/0030835 A1 Feb. 10, 2005

(51) Int. Cl.
*G04B 47/00* (2006.01)

(52) U.S. Cl. ..... 368/10; 368/223; 368/242

(58) Field of Classification Search ..... 368/10, 368/327, 223, 242
See application file for complete search history.

(56) References Cited

U.S. PATENT DOCUMENTS

| | | | | |
|---|---|---|---|---|
| 3,999,050 | A | 12/1976 | Pitroda | |
| 4,142,306 | A | 3/1979 | Whitlock | |
| 4,193,120 | A | 3/1980 | Yello | |
| 4,387,420 | A | 6/1983 | Singhi et al. | |
| 4,698,783 | A * | 10/1987 | Nishimuro et al. | 368/10 |
| RE32,655 | E | 4/1988 | Levine | |
| 4,888,748 | A | 12/1989 | Lagasse et al. | |
| 5,083,123 | A | 1/1992 | Ganter et al. | |
| 5,199,009 | A * | 3/1993 | Svast | 368/240 |
| 5,525,958 | A | 6/1996 | Negishi et al. | |
| 5,850,220 | A * | 12/1998 | Motai | 715/867 |
| 5,855,006 | A * | 12/1998 | Huemoeller et al. | 705/9 |
| 5,881,023 | A | 3/1999 | Gu et al. | |
| 6,022,314 | A * | 2/2000 | Wei | 600/300 |
| 6,414,907 | B1 * | 7/2002 | Pennington | 368/10 |
| 6,448,887 | B1 | 9/2002 | Martin et al. | |
| 6,483,779 | B1 | 11/2002 | Teixeira | |
| 6,507,275 | B1 | 1/2003 | Romano et al. | |
| 6,714,486 | B1 * | 3/2004 | Biggs | 368/82 |
| 6,920,089 | B1 * | 7/2005 | Steinbach | 369/22 |

* cited by examiner

*Primary Examiner*—Daniel J. Collita
*Assistant Examiner*—Leo T. Hinze
(74) *Attorney, Agent, or Firm*—Thomas R. Williamson, III; Joel D. Myers; Barry E. Kaplan

(57) ABSTRACT

The invention is an informational clock, wherein the clock displays information correlating to time displayed on the clock. Information is also varied by a randomizer, wherein a specific entry of information in a database, within an array selected to correlate with the time, is determined at random. Database information can be downloaded and be thematically-based.

18 Claims, 4 Drawing Sheets

APPARATUS AND METHOD FOR DISPLAYING TIME AND RANDOMLY-SELECTED TEXT INFORMATION

TECHNICAL FIELD

The present invention relates generally to devices for measuring time, and more specifically to an apparatus and method for displaying informational messages randomly selected from a database, yet keyed to the numerical composition of a measured time displayed on a clock.

BACKGROUND OF THE INVENTION

There are various clock devices and methods previously known, but which all are disadvantageous when compared to the present invention:

One device shows historical data displayed on a tape that comprises part of a clock, but the tape cannot be randomly accessed. This is disadvantageous because it does not permit the randomization of data, nor is the information displayed coordinated with the time in any way.

Various programmable appointment schedulers provide information related to specific times, as input by the user for future recall. These lack the ability to display random pieces of information from a database and thus are disadvantageous.

While some or all of the above-referenced devices may well be utilized for keeping information and displaying it to a user, they do not adequately provide for the display of random information keyed to the numerical configuration of the display.

BRIEF SUMMARY OF THE INVENTION

Briefly described, in a preferred embodiment, the present invention overcomes the above-mentioned disadvantages and meets the recognized need for such a device by providing a method and apparatus for displaying time and an associated informational message selected from a database, wherein the message selected is numerically related to the time displayed.

According to its major aspects and broadly stated, the present invention in its preferred embodiment is a digital clock, wherein the time measured and displayed thereby represents not only the time itself, but also a one-dimensional or multi-dimensional array in a database containing information related to the value of numbers in the time displayed.

More specifically, the present invention is a clock incremented by a time base clock frequency, wherein increments in the minutes of time displayed result in selection of an associated column of an array in a database. Selection of the column is based on the numerically-displayed value of the time, and a random number is coincidentally generated, wherein the random number is utilized to select an entry within the chosen column of the array.

The present apparatus and method further provides information from pre-programmed and/or user-selected categories, wherein the information is encoded in an alterable, programmable, read-only memory. The information may be downloadable and flash programmed into read-only memory.

Accordingly, a feature and advantage of the present invention is its ability to provide random factual information for the educational benefit of the user.

A feature and advantage of the present invention is its convenient use during travel.

A feature and advantage of the present invention is its re-programmable database of information for user customization.

A feature and advantage of the present invention is its ability to display advertisements.

A feature and advantage of the present invention is its ability to be powered via line current and/or portable energy sources.

A feature and advantage of the present invention is its ability to provide randomly-displayed and continuously-changing educational and/or advertising information through the duration of the day.

Another feature and advantage of the present invention is its ability to be used to provide questions or answers for use in a trivia game.

These and other features and advantages of the present invention will become more apparent to one skilled in the art from the following description and claims when read in light of the accompanying drawings.

BRIEF DESCRIPTION OF THE DRAWINGS

Figure 1:
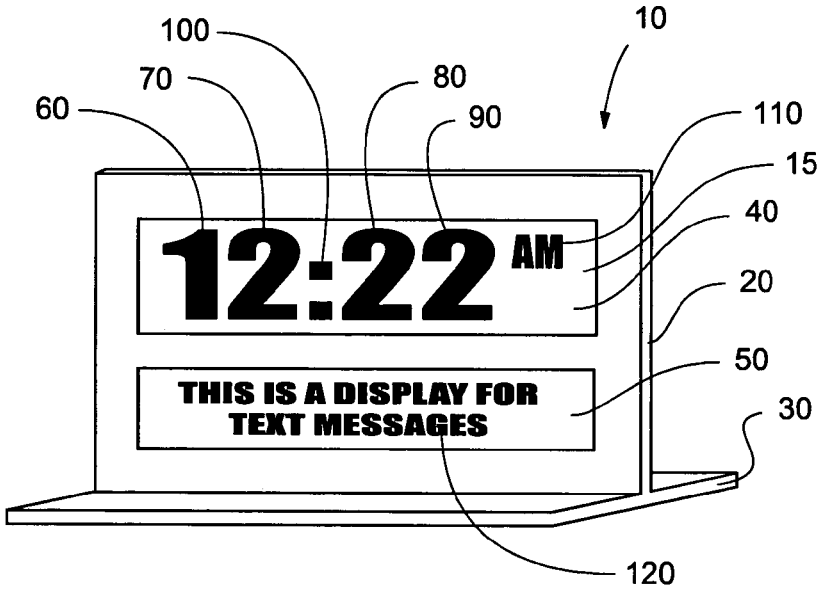
Figure 5:
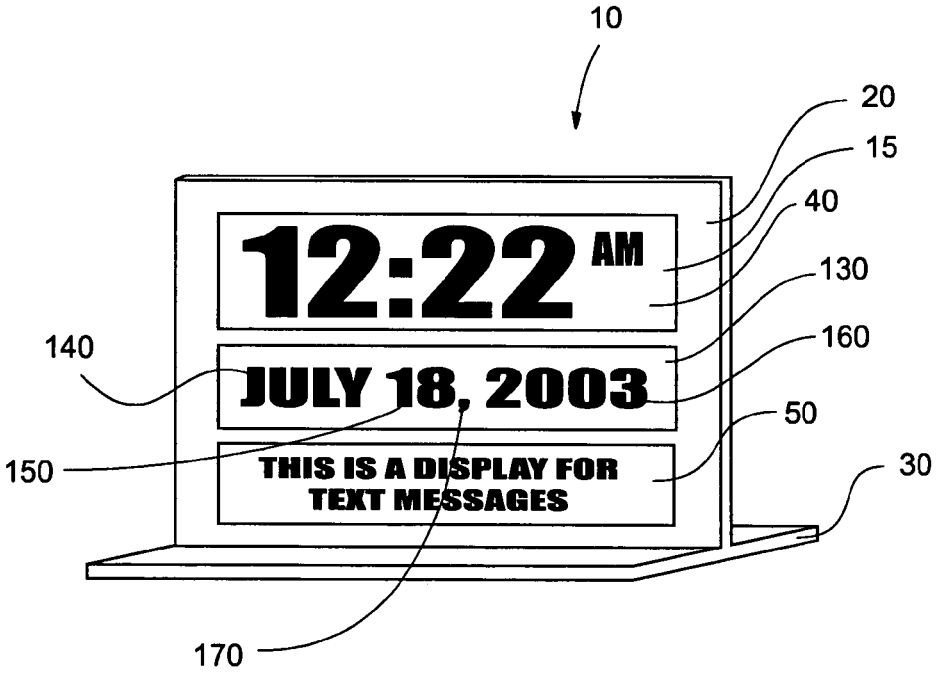
Figure 2:
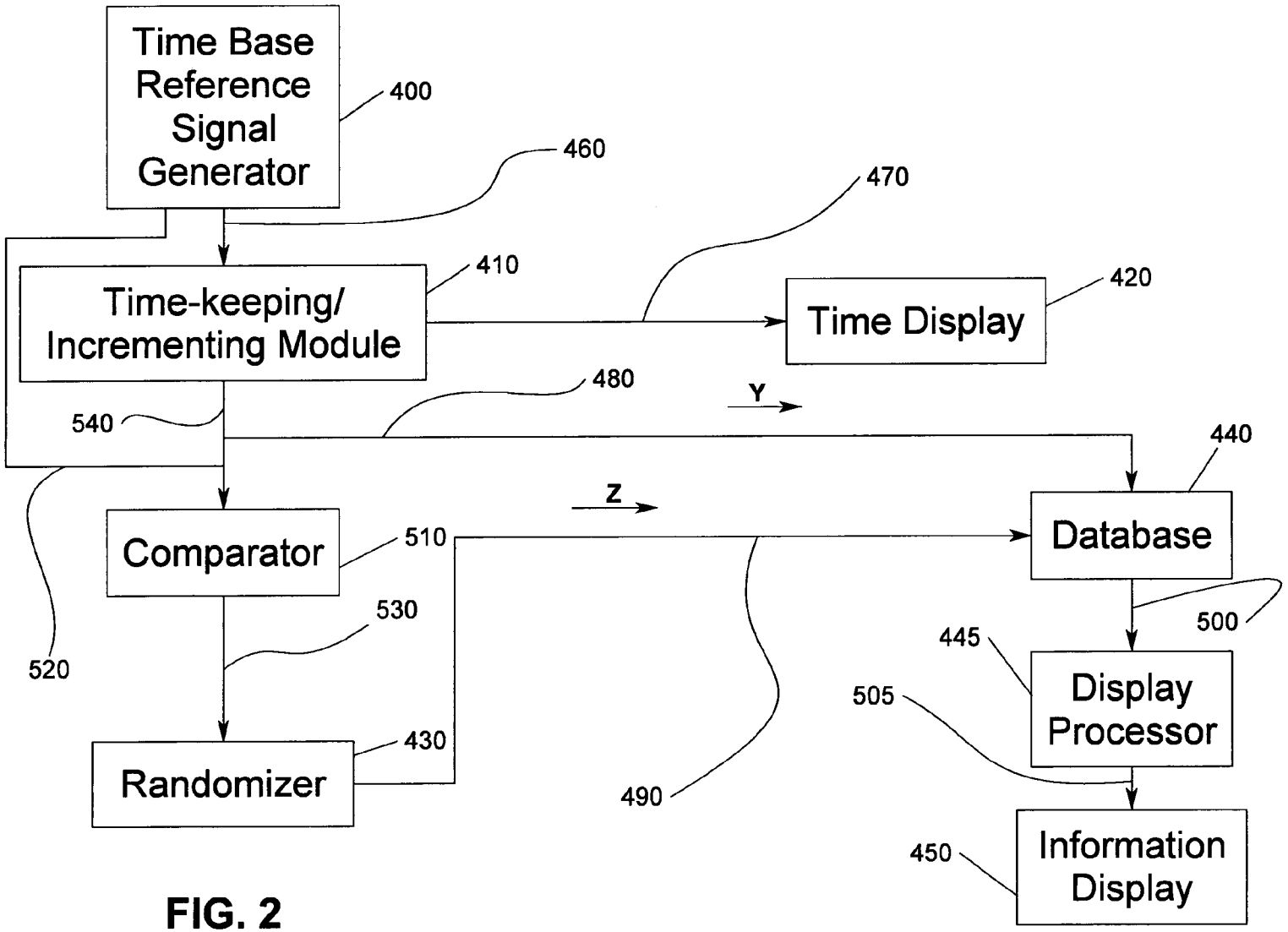
Figure 3A:
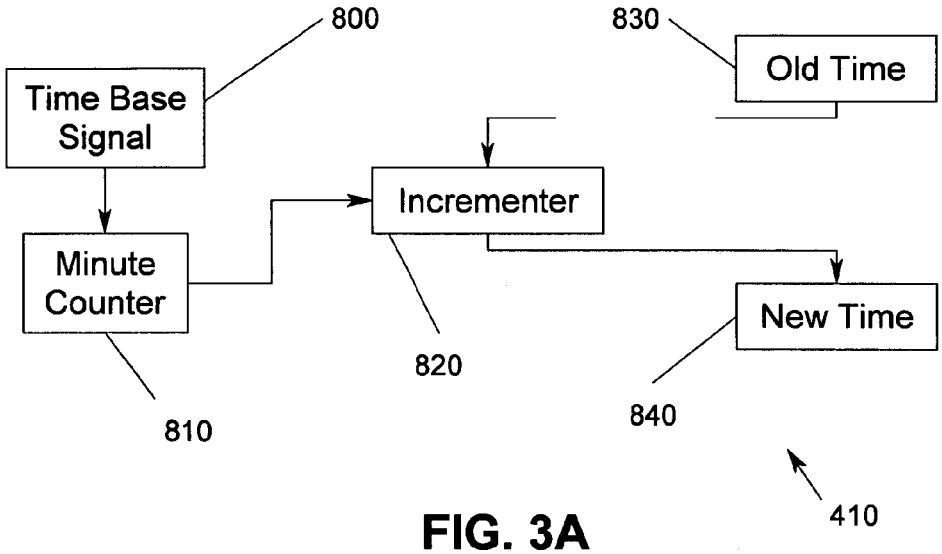
Figure 3B:
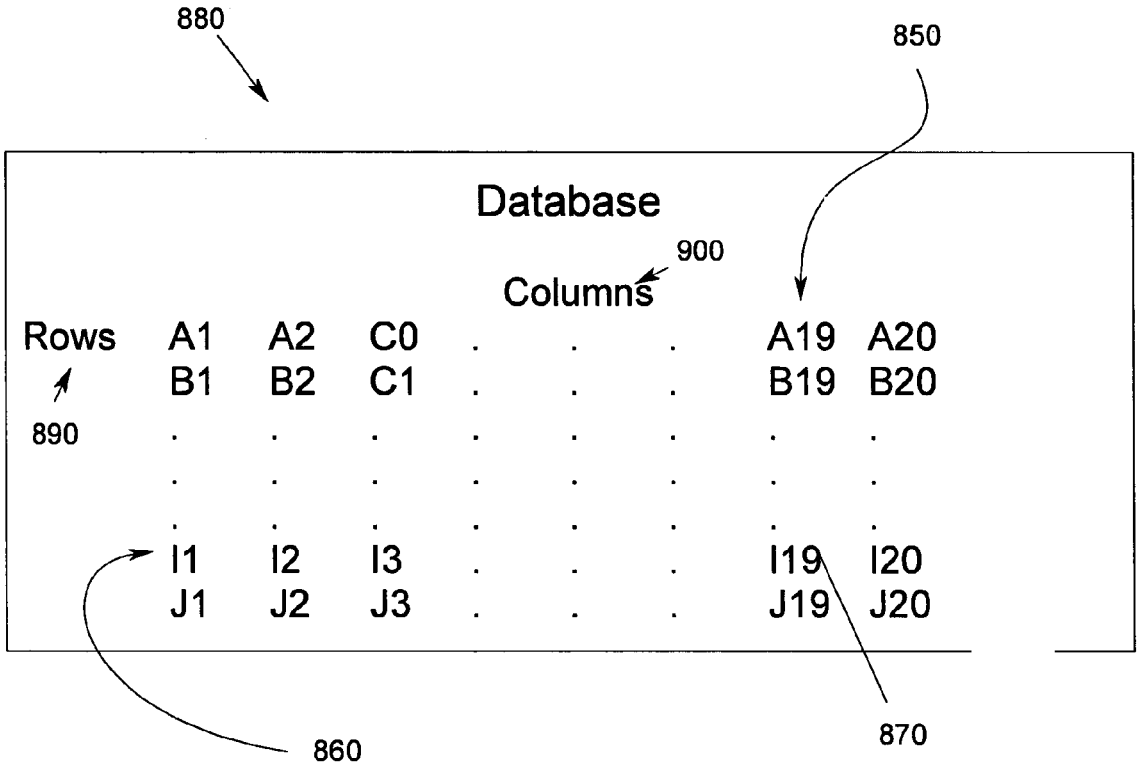
Figure 4:
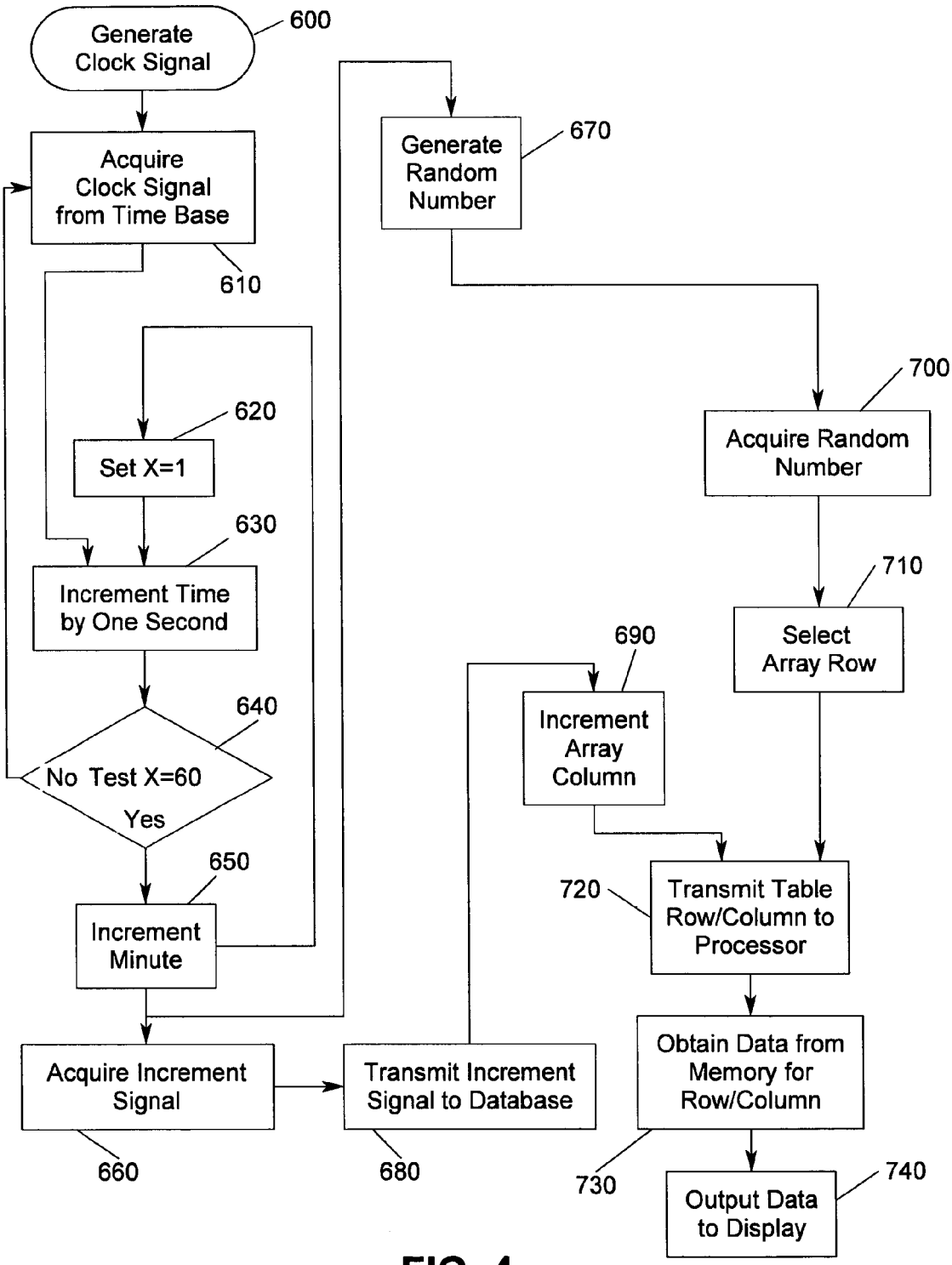

Having thus described the invention in general terms, the present invention will be better understood by reading the Detailed Description of the Preferred and Selected Alternate Embodiments with reference to the accompanying drawing figures, which are not necessarily drawn to scale, and in which like reference numerals denote similar structures and refer to like elements throughout, and in which:

FIG. 1 is a perspective view of an apparatus according to a preferred embodiment of the present invention;

FIG. 2 is a modular component diagram of an apparatus according to a preferred embodiment of the present invention;

FIG. 3A is a detailed diagram of the component sections of the time-keeping/incrementer module of an apparatus according to a preferred embodiment of the present invention;

FIG. 3B illustrates the matrix array of data in the database of an apparatus according to a preferred embodiment of the present invention;

FIG. 4 is an operational flow chart of an apparatus and method of a preferred embodiment of the present invention; and FIG. 5 is a perspective view of an apparatus according to an alternate embodiment of the present invention.

DETAILED DESCRIPTION OF THE PREFERRED AND ALTERNATIVE EMBODIMENTS

In describing the preferred and selected alternate embodiments of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Briefly, the present apparatus and method arose from a need to provide a device that displays randomly-selected information, variable in accord with the device's measured and displayed value of the time, and in response to a randomizer. Data is preferably stored locally in a programmable memory database within the device, wherein the database of information can preferably be selectively or periodically changed via download from new or updated information databases from a computer or global networking system.

Referring now to FIG. 1, apparatus 10 is preferably a time measuring device in the form of clock 15, wherein clock 15 preferably includes frame 20 and base 30. Base 30 preferably facilitates maintaining apparatus 10 in the upright position, such that frame 20 can be easily viewed. Frame 20 preferably has therein time display 40 and message display 50. Time display 40 preferably shows tens of hours 60 followed by hours 70, preferably in the form of digital display digits. Time display 40 further preferably shows tens of minutes 80 and minutes 90, also preferably in the form of digital display digits. Hours 70 are preferably separated from tens of minutes 80 preferably via colon 100. Preferably located proximate minutes 90 is time of day indicator 110 for indicating AM or PM times.

Message display 50 is preferably located below time display 40, wherein message display 50 preferably possesses alphanumeric character digits 120 suitable for forming words, phrases and/or sentences. Time display 40 and message display 50 may be any suitable display device, such as, for exemplary purposes only, a liquid crystal display or a cathode ray tube display. In an alternate embodiment, message display 50 and/or time display 40 could be projected and magnified onto a wall surface or the like for viewing same, external to apparatus 10, as known within the art.

Turning now to FIG. 2, time base reference 400 preferably provides a clock frequency signal preferably derived from the alternating-current mains line frequency. Specifically, where the alternating-current mains line frequency is 60 Hz, a time counter for seconds that is preferably stable and accurate over time may be readily derived from the alternating mains line frequency, as is known in the art. However, if no mains power is present, or if the mains line frequency is other than 60 Hz, provision of a 60 Hz signal may be made through the use of, for exemplary purposes only, a crystal-controlled clock or an astable multivibrator, or other such clock signal as is known within the art.

The signal generated by time base reference 400 preferably passes via route 460 to time-keeping/incrementing module 410. Time-keeping/incrementing module 410 preferably computes the time by incrementing the current time upon receipt of the signal from time base reference 400. Time-keeping/incrementing module 410 further preferably provides output, such as, for exemplary purposes only, binary-coded decimal (BCD) output, that preferably travels to time display 420, preferably via route 470, and to database 440, preferably via route 480. Time display 420 preferably depicts current time in digital form as described above. Database 440 preferably receives input in BCD form from time-keeping module 410. The BCD data code preferably selects with particularity a column within the multi-dimensional database array, preferably stored in a non-volatile read-only memory and coordinated to the particular BCD number coded.

For explanatory and exemplary purposes only, there exist 720 unique combinations of time displays that time-keeping/incrementing module 410 can generate, to wit, 24 hours multiplied by 60 minutes per hour. Accordingly, there can be 720 unique columnar arrays having a plurality of data entries or data cells therein. By including time of day indicator 110 binary information, or alternately, by utilizing a 24-hour clock display, the quantity of unique numbers that can be generated, and thus the quantity of columnar arrays, rises to 1,440.

Referring now to FIGS. 2, 3A, 3B and 4, randomizer 430 preferably generates a random number, wherein the random number is preferably transmitted to database 440 via route 490. Upon arrival at database 440, the random number preferably selects an entry 870 in matrix array 880 (see FIG. 3B), wherein matrix array 880 comprises a series of rows 890 and a series of columns 900 (illustrated and limited to ten rows and twenty columns in the figure for the purpose of simplicity). For instance, column 850 (i.e., A19 to J19) is selected by the unique code associated with the BCD number received from time-keeping module 410. Time-keeping module 410 receives time base signal 800, and subsequently sends signal 800 to minute counter 810. Minute counter 810 preferably triggers incrementer 820, wherein incrementer 820 then acquires old time 830 and increments same to new time 840, thus providing the unique code to select column 850. Specific entry 870 (i.e., I19) is selected from column 850 via row 860 (i.e., I1 to I20) by reference to the random number. As such, unique entry 870 is preferably selected from database 440, and transmitted via route 500 to information display 450, wherein information contained with unique entry 870 is subsequently displayed on information display 450.

A more detailed and preferred matrix array of an apparatus 10, having a 24-hour clock is illustrated in TABLE I below, for explanatory and exemplary purposes only:

TABLE I 24-hour Clock Display Numbers

| Time | 00:01A | 00:02A | | 03:58P | | 11:58P | 11:59P |
|---|---|---|---|---|---|---|---|
| Value | 1 | 2 | . . . | 358 | . . . | 1159 | 1159 |
| Array Element | 1 | 2 | . . . | 958 | . . . | 1438 | 1439 |
| Random Digit | | | | | | | |
| 0 | A1 | A2 | | A958 | | A1438 | A1439 |
| 1 | B1 | B2 | | B958 | | B1438 | B1439 |
| . | | | | | | | |
| . | | | | | | | |
| . | | | | | | | |
| 8 | I1 | I2 | | I958 | | I1438 | I1439 |
| 9 | J1 | J2 | | J958 | | J1438 | J1439 |

wherein

A1, B1 . . . I1 and J1 all relate to the time 00:01, or 12:01 AM, as the numerical value '1';

A2, B2 . . . I2 and J2 all relate to the time 00:02, or 12:02 AM, as the numerical value '2';

A958, B958 . . . I1958 and J958 all relate to the time 15:38 or 03:58 PM, as the numerical value '358';

A1438, B1438 . . . I1438 and J1438 all relate to the time 23:58 or 11:58 PM, as the numerical value '1158'; and A1439, B1439 . . . I1439 and J1439 all relate to the time 23:59 or 11:59 PM, as the numerical value '1159'.

Accordingly, the multi-dimensional array column A1 . . . J1 corresponds to the random numbers 0 through 9, wherein each columnar array element (A1–J1) relate to the numerical value '1' for purposes of providing selected information, such as, for exemplary purposes only, A1=one gram of carbohydrates in a package of SWEET'N'LOW, B1=one satellite for the planet Earth, . . . , I1=un (masculine 'one' in French) and J1=hole in one, lowest score for a hole in golf. Similarly, and for exemplary purposes only, A2=two carbohydrates in an ATKINS ENDULGE chocolate bar, B2=two legs on a biped, . . . , I2=zwei (two in German) and J2=two players in singles tennis.

Rows in the multi-dimensional array of Table I correspond to selected categories, such as, for exemplary purposes only, and as depicted in the example above, row A relates to dietary information, row B relates to scientific information, row I relates to foreign language information, and row J relates to sports information. While ten rows of different categories are shown in the above example, it should be understood by those in the art that fewer numbers of categories could be provided as selected by a random number generator providing fewer than ten single-digit numbers. It is also understood that more than ten numbers could be utilized. It is further understood that rows and columns, and the information provided therein, could be interchanged.

As depicted in Table I above, the rows correspond to specific topics or categories. Specifically, and in continuance with the above example of row J and corresponding namely sports information category, category J might include:

J358=0.358 Alex Rodriguez' batting average, Seattle Mariners, 1996.

J1158=Field Goals scored by Kareem Abdul-Jabbar of Milwaukee, 1971–1972 season.

J1159=Receiving yardage by Sonny Randle, St. Louis Cardinals, 1962.

Preferably, the relationship between the components of apparatus 10 and the associated method of operation of same is more aptly described with collective reference to FIGS. 1–4. Time base reference signal generator 400 preferably generates a clock signal in step 600, wherein the clock signal is preferably acquired by time-keeping/incrementing module 410 in step 610 (as best illustrated in FIG. 3A). Time-keeping/incrementing module 410 then preferably increments 630 time count X by one second and then subsequently passes time count X to comparator 510 via connection 540, wherein comparator 510 is preferably triggered by clock signal 600, via connection 520, to test 640 whether time count X has reached sixty seconds. If time count X does not equal sixty seconds, time-keeping/incrementing module 410 preferably responds to next clock signal 600 acquired from timebase 610, and, once again, preferably increments 630 time count X by one second, wherein comparator 510, in response, to clock signal 600, preferably conducts tests 640 again to determine whether time count X has reached sixty seconds. If time count X has reached sixty seconds, minutes 90 are preferably incremented 650 and time count X is preferably reset 620 to one. Increment of minutes 90 is preferably transmitted via connection 470 from time-keeping/incrementing module 410 to time display 420. Time-keeping/incrementing module 410 preferably transmits information Y to database 440, wherein information Y represents the value of the numerically-displayed time 40. Contemporaneous with transmission of information Y to database 440, comparator 510 preferably sends a signal via connection 530 to randomizer 430, wherein randomizer 430 preferably generates 670 random number Z. Random number Z is preferably subsequently transmitted 680 via connection 490 to database 440 (as best illustrated in FIG. 3B) for purpose of variation of data selected.

Contemporaneous with the generation of a random number (i.e., between zero and nine) by randomizer 430, a one-dimensional array is selected within database 440 to numerically equal the newly-incremented time value displayed on time display 40 and to reflect the new value of the time digits. Random number Z is acquired 700 by database 440 and selects 710 an entry in a one-dimensional array. The data entry information from the array cell is transmitted 720 via connection 500 to display processor 445, and subsequently output to the information display 450 via connection 505. Upon receipt of the next time signal, the present method begins anew at step 620 and continues until the time is 11:59 AM or 11:59 PM. Upon receipt of the next time base signal, the time is changed to 12:00 AM, or 12:00 PM.

FIG. 5 illustrates an alternative embodiment of apparatus 10, wherein the present alternate embodiment incorporates date display section 130. Date display section 130 displays the current month 140, day 150 and year 160, wherein day 150 and year 160 are separated by comma 170. It is further contemplated that database tabular array 880 can be selected based upon digits from time display 40, or the date display section 130, or both, thus providing a multitude of possible selections.

It is contemplated in another alternate embodiment that a single dimensional array could be utilized, thus eliminating the need for randomly generating a number to select from the array. In such an embodiment, the information for a clock utilizing numbers for a non-randomized array could be represented as follows:

Calorie Clock (Time is translated into numbers only)

1:39 AM or PM=139=139 Calories in a can of COKE.

1:43 AM or PM=143=143 Calories in a banana.

3:11 AM or PM=311=311 Calories in a SNICKERS bar.

5:15 AM or PM=515=515 Calories in a MACDONALD'S QUARTER POUNDER WITH CHEESE.

6:59 AM or PM=659=659 Calories in a BURGER KING chicken sandwich.

It is further envisioned in an alternate embodiment that the time numbers could represent an historical date, as follows:

11:18=November 18: US invades Nicaragua, later overthrows President Zelaya in 1909.

12:07=December 7: Japanese forces attack US forces at Pearl Harbor, Hawaii in 1941.

2:22=February 22: Battle of Buena. Vista, US tropps beat Mexican army in 1847.

3:08=March 8: Fist US ground combat troops, 3500 soldiers, enter South Vietnam in 1965.

6:16=June 16: US government signs treaty for annexation of Hawaii in 1897.

Additionally, in this embodiment, there could be several alternative dates chosen at random, such as, for exemplary purposes only, those below which all relate to 6:16, or June 16:

1858, Senate candidate Abraham Lincoln said the slavery issue had to be resolved, declaring "A house divided against itself cannot stand."

1897, the US government signed a treaty for the annexation of Hawaii.

1932, President Hoover and Vice President Charles Curtis were re-nominated at the Republican national convention in Chicago.

1978, President Carter and Panamanian leader Omar Torrijos exchanged the instruments of ratification for the Panama Canal treaties.

It is further contemplated that a combination of dates and numbers within the same database could relate to the numbers displayed, as follows:

3:08=March 8=date in 1999 that Yankee great Joe DiMaggio died.

4:17=4.17=career earned run average of Lefty Gomez.

5:48=548=number of career home runs for Philadelphia Phillies' Mike Schmidt.

6:13=June 13=date in 2003 that Roger Clemens of New York Yankees beats St. Louis Cardinals for 300$^{th}$ career victory.

7:14=714=number of home runs hit by the great Babe Ruth.

It is envisioned in yet another alternate embodiment that the present invention could utilize randomly-generated number Z for selection between various thematic arrays included within database 440.

It is contemplated in another alternate embodiment that a user-selectable switch could be included to fix the selection of a thematic array within database 440 by disabling random number generator 670.

It is envisioned in still another alternate embodiment that a display of seconds could be included on time display 40, wherein the resulting numerical value displayed, including minutes and hours numerically-displayed information, could be provided to database 440 for selection of a matrix array, and wherein message display 50 could be changed with greater frequency than once per minute via a separately regulated counter/comparator.

It is contemplated in an alternate embodiment that a user-selectable component could be added to apparatus 10 to reduce the frequency of variation of information in message display 50 to allow for longer display periods for messages, or to increase the frequency of variation to provide a shorter display period.

It is envisioned in an alternative embodiment that a chime could announce the changing of message 50.

It is contemplated in an alternative embodiment that the quantity of random numbers possible of generation would be in excess of ten.

It is further envisioned that the present apparatus and method could include an alarm function to awaken or alert the user to a particular time.

It is also contemplated that the time and/or the message could be audibly announced.

It is further envisioned that the display of time and/or messages could be accomplished by a projection mechanism, allowing display on a wall, ceiling, or the like.

It is also contemplated that the present apparatus and method could be designed to display a message that is selected by numerical display 40 of the time on clock 15, but is not related thereto. In such an embodiment, messages in database 440 could be selected by their position in the array based on the numerically-displayed information, but would otherwise have no numerical relationship to the time displayed.

It is further contemplated that the present invention could provide information relavant to sports trivia, movie trivia, music trivia, mathematical equations, language translations and/or grammar, caloric content of foods, historic events of any countries, and or any other desired topic or category.

It is further envisioned that the present apparatus and method could be incorporated into any form of time measuring device, such as, for exemplary purposes only, digital or analog watches, clocks, and such like.

It is envisioned in a further alternative embodiment that the transition from one minute to the next could generate a signal that could trigger the time reading to be transmitted to database 440 and display 50 to upgrade to the new message.

It is further envisioned in an alternative embodiment that the present invention could display advertisements, such as, for exemplary purposes only, an advertisement for an item whose cost is the same as the number displayed on the clock.

It is also envisioned in an alternative embodiment that the message could scroll across the display.

The foregoing description and drawings comprise illustrative preferred and alternate embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing the steps of the method in a certain order does not necessarily constitute any limitation on the order of the steps of the method. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation. Accordingly, the present invention is not limited to the specific embodiments illustrated herein, but is limited only by the following claims.

What is claimed is:

1. An information display device comprising:

at least one time measuring device having a display of numbers comprising time digits;

at least one database having at least one array of cells comprising stored information;

means for selecting said stored information utilizing said display of numbers, wherein said selecting means selects a cell from said at least one array, and wherein said cell comprises data numerically related to said display of numbers; and means for displaying said stored information.

2. The information display device of claim 1, wherein said at least one database is a uni-dimensional array database.

3. The information display device of claim 1, wherein said at least one database comprises a two-dimensional array.

4. The information display device of claim 3, wherein said at least one database comprises data grouped according to a plurality of subjects.

5. The information display device of claim 1, wherein said means for selecting said stored information further comprises a random number generator, wherein said random number generator enables random selection of a cell from said array of cells.

6. The information display device of claim 1, wherein said at least one database is storable within at least one memory.

7. The information display device of claim 6, wherein said at least one memory is non-volatile.

8. The information display device of claim 6, wherein said at least one memory is alterable.

9. The information display device of claim 8, further comprising a connection to a computer for selectively programming a new database into said at least one memory.

10. The information display device of claim 1, wherein said database comprises data relating to a theme.

11. The information display device of claim 1, wherein said means for displaying comprises a liquid crystal display.

12. A method of displaying information comprising the steps of:

a) providing at least one time measuring device;

b) coding the time displayed on said at least one time measuring device;

c) providing at least one database;

d) selecting data from said at least one database based on said coding, wherein said data is numerically related to said time displayed; and e) displaying said data.

13. The method of displaying information of claim 12, wherein said at least one database is alterable.

14. The method of displaying information of claim 13, further comprising the steps of:

downloading a second database; and altering said at least one alterable database.

15. The method of displaying information of claim 12, further comprising the step of:

d') generating a random number for identifying data within said at least one database.

16. The method of displaying information of claim 12, further comprising the step of:

c') arranging said at least one database into at least one thematic group.

17. The method of displaying information of claim 12, further comprising the step of:

b') periodically changing said coding.

18. The method of displaying information of claim 17, further comprising the step of:

b") generating a random number for identifying data within said at least one database.

* * * * *